US008624525B2

(12) United States Patent
Kuo et al.

(10) Patent No.: US 8,624,525 B2
(45) Date of Patent: Jan. 7, 2014

(54) FLAT DISPLAY, BACKLIGHT MODULE AND DRIVING METHOD THEREOF

(75) Inventors: Chen Lung Kuo, Tainan County (TW); Cheng Cheng Pan, Kaohsiung County (TW); Pao Wei Cheng, Tainan (TW)

(73) Assignee: Chimei Innolux Corporation, Miao-Li County (TW)

( * ) Notice: Subject to any disclaimer, the term of this patent is extended or adjusted under 35 U.S.C. 154(b) by 316 days.

(21) Appl. No.: 12/903,251

(22) Filed: Oct. 13, 2010

(65) Prior Publication Data

US 2011/0089860 A1 Apr. 21, 2011

(30) Foreign Application Priority Data

Oct. 19, 2009 (TW) ..... 98135310 A

(51) Int. Cl.
*H05B 37/02* (2006.01)

(52) U.S. Cl.
USPC ..... 315/294; 315/307; 315/360

(58) Field of Classification Search
USPC ..... 315/169.1–169.4, 291, 294, 307; 349/15; 345/102; 359/462, 463, 464, 359/630
See application file for complete search history.

(56) References Cited

U.S. PATENT DOCUMENTS

| | | | | |
|---|---|---|---|---|
| 8,004,622 | B2 * | 8/2011 | Schultz et al. | 349/15 |
| 8,022,895 | B2 * | 9/2011 | Tsao | 345/6 |
| 2002/0180664 | A1 | 12/2002 | Tomida et al. | |
| 2004/0183465 | A1 | 9/2004 | Jang | |
| 2006/0049959 | A1 | 3/2006 | Sanchez | |
| 2006/0181895 | A1 | 8/2006 | Hu et al. | |
| 2007/0222400 | A1 | 9/2007 | Sanchez-Olea | |
| 2007/0252535 | A1 | 11/2007 | Fukumoto et al. | |
| 2008/0013001 | A1 | 1/2008 | Jang et al. | |
| 2010/0073768 | A1 * | 3/2010 | Kim et al. | 359/463 |
| 2011/0012896 | A1 * | 1/2011 | Ji | 345/419 |
| 2011/0115889 | A1 * | 5/2011 | Kim et al. | 348/56 |

FOREIGN PATENT DOCUMENTS

| | | | |
|---|---|---|---|
| CN | 1953563 | A | 4/2007 |
| CN | 101010965 | A | 8/2007 |
| CN | 101056066 | A | 10/2007 |
| CN | 101236726 | A | 8/2008 |
| CN | 101557670 | A | 10/2009 |
| CN | 101738733 | A | 6/2010 |
| CN | 101783968 | A | 7/2010 |
| EP | 1777575 | A2 | 4/2007 |
| KR | 20060131015 | A | 12/2006 |
| KR | 10-2007-1018986 | A | 11/2007 |
| KR | 20070108986 | A | 11/2007 |

OTHER PUBLICATIONS

Office Action as issued on Jun. 20,2 013 by State Intellectual Property of the People's Republic of China.

* cited by examiner

*Primary Examiner* — Tung X Le
(74) *Attorney, Agent, or Firm* — Lowe Hauptman & Ham, LLP

(57) ABSTRACT

A flat display used for displaying a 2D image and a 3D image is provided. The flat display includes a panel and a backlight module. The backlight module provides a light to the panel. When the flat display displays the 2D image, the backlight module provides a first light intensity to the panel. When the flat display displays the 3D image, the backlight module provides a second light intensity to the panel. The second light intensity is higher than the first light intensity.

15 Claims, 3 Drawing Sheets

FLAT DISPLAY, BACKLIGHT MODULE AND DRIVING METHOD THEREOF

RELATED APPLICATIONS

This application claims the benefit of Taiwan application Serial No. 98135310, filed Oct. 19, 2009, the subject matter of which is incorporated herein by reference.

BACKGROUND

1. Technical Field

The present disclosure relates in general to a flat display, a backlight module and a driving method thereof, and more particularly to a flat display, a backlight module and a driving method thereof capable of resolving light intensity (or also named luminance) deficiency.

2. Related Art

As the 2D display technology becomes more and more matured, the 3D display technology is viewed as the product making a new era of display technology. Of the various breakthroughs in the 3D display technology, the 2D/3D image switching technology is critical for the existing image industries to enter the 3D image. The 2D/3D image switching technology enables the viewer to switch between the 2D display and the 3D display according to personal preference or the contents of the image. According to the existing 2D/3D image switching technology, when the display is switched to 3D image from 2D image, so that the transmittance of the displaying image will be decreased when generating a 3D image (for example, when the liquid crystal display shows the 3D image, a pair of glasses is needed to create the image parallax between the viewer's two eyes), but the light source is not adjusted simultaneously, so that the overall light intensity deteriorates. And the viewer will feel the 3D image darker which lower the image quality.

SUMMARY

In one or more embodiments, a flat display, a backlight module and a driving method are provided thereof. When the display is switched between the 2D image and the 3D image, the light intensity is adjusted to resolve light intensity deficiency for the flat display.

In one or more embodiments, a flat display used for displaying a 2D image and a 3D image is provided. The flat display includes a panel and a backlight module. The backlight module provides a light to the panel. When the flat display displays the 2D image, the backlight module provides a first light intensity to the panel. When the flat display displays the 3D image, the backlight module provides a second light intensity to the panel. The second light intensity is higher than the first light intensity.

In one or more embodiments, a backlight module used for providing a light to a panel is provided. The backlight module includes a light emitter unit, a resistor module, an inverter and a balance circuit. The light emitter unit includes a number of cold cathode fluorescent lamps (CCFLs). The resistor module and the light emitter unit are connected in series. The inverter receives and converts an input voltage into a first cross-voltage and further transmits the cross-voltage to the light emitter unit and the resistor module which are coupled in series. The balance circuit transmits a compensation signal to the inverter according to respective values of a number of currents flowing through these cold cathode fluorescent lamps. When the panel displays a 2D image, the resistor module provides a first resistance value so that a first current flows through the light emitter unit to generate a first light intensity. When the panel displays a 3D image, the resistor module provides a second resistance value so that a second current flows through the light emitter unit to generate a second light intensity. The second resistance value is lower than the first resistance value. The value of the second current is higher than the value of the first current. The second light intensity is higher than the first light intensity.

In one or more embodiments, a backlight module used for providing a light to a panel is provided. The backlight module includes a light emitter unit, a boost circuit, a resistor module and a balance circuit. The light emitter unit includes a number of light emitting diodes (LEDs). The boost circuit receives an input voltage and converts it. The resistor module is coupled to the boost circuit and the light emitter unit. The balance circuit transmits a compensation signal to the boost circuit according to respective values of a number of currents flowing through these light emitting diodes. When the flat display displays a 2D image, the resistor module provides a first resistance value so that the boost circuit converts the input voltage into a first cross-voltage for enabling the light emitter unit to generate a first light intensity. When the flat display displays a 3D image, the resistor module provides a second resistance value so that the boost circuit converts the input voltage into a second cross-voltage for enabling the light emitter unit to generate a second light intensity. The second resistance value is lower than the first resistance value. The second cross-voltage is higher than the first cross-voltage. The second light intensity is higher than the first light intensity.

In one or more embodiments, a flat display driving method is provided. The flat display includes a panel and a backlight module. The flat display driving method includes the following steps. When the flat display displays a 2D image, the backlight module provides a first light intensity to the panel. When the flat display displays a 3D image, the backlight module provides a second light intensity to the panel. The second light intensity is higher than the first light intensity.

BRIEF DESCRIPTION OF THE DRAWINGS

A detailed description of several exemplary embodiments will be now given with reference to the accompanying drawings, which are given for illustration only, and thus are not limitative of the present disclosure, wherein the same references relate to the same elements and wherein.

DETAILED DESCRIPTION

In one or more embodiments, a flat display, a backlight module and a driving method are provided thereof. When the display is switched between the 2D image and the 3D image, the light intensity of the backlight module is adjusted to resolve light intensity deficiency for the flat display.

Figure 1:
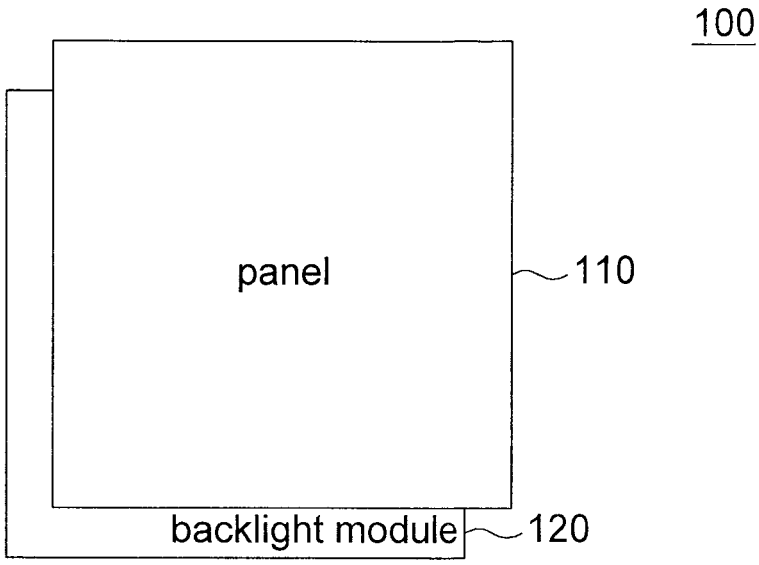
FIG. 1 shows a flat display according to a first embodiment.

As shown in FIG. 1, a flat display 100 of a first embodiment includes a panel 110 and a backlight module 120. The backlight module 120 provides a light to the panel 110. When the flat display 100 displays a 2D image, the backlight module 120 provides a first light intensity to the panel 110. When the flat display 100 displays a 3D image, the backlight module 120 provides a second light intensity to the panel 100. The second light intensity is higher than the first light intensity.

Figure 2:
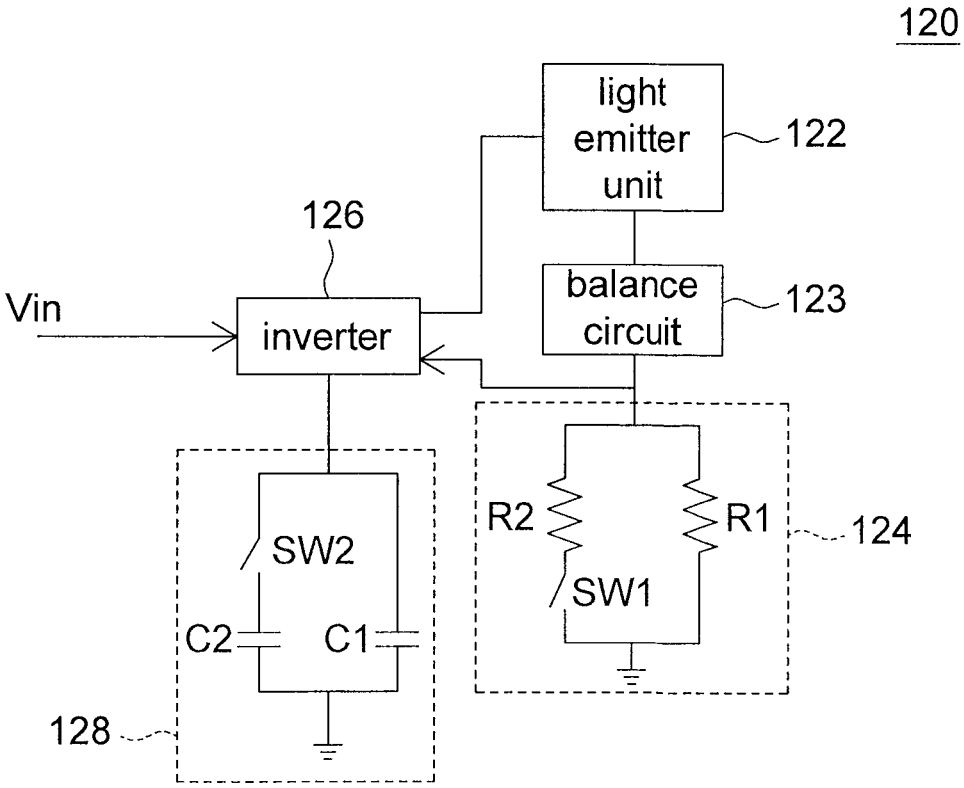
FIG. 2 shows a backlight module according to the first embodiment.

As shown in FIG. 2, the backlight module 120 of the first embodiment includes a light emitter unit 122, a balance circuit 123, a resistor module 124 and an inverter 126. The light emitter unit 122 includes a number of cold cathode fluorescent lamps (CCFLs). The inverter 126 receives and converts an input voltage $V_{in}$ into a first cross-voltage, and further transmits the first cross-voltage to the light emitter unit 122 and the resistor module 124 which are coupled in series. The balance circuit 123 judges respective values of a number of currents flowing through a number of cold cathode fluorescent lamps, and further transmits a compensation signal to the inverter 126 according to respective values of the currents flowing through these cold cathode fluorescent lamps to perform feedback compensation so as to maintain balance between the currents flowing through these cold cathode fluorescent lamps. The balance circuit 123 is such as coupled between the light emitter unit 122 and the resistor module 124, and any other types of coupled condition can be used and are within the scope of this disclosure.

The resistor module 124 includes a first resistor R1, a second resistor R2 and a switch SW1 such as shown in FIG. 2, wherein, the signal for controlling the ON/OFF of the switch SW1 can be provided by such as a scaler, a timing controller or other control units. When the flat display 100 displays a 2D image, the switch SW1 is turned off, and the resistor module 124 provides a first resistance value (which equal to the resistance value of the resistor R1). In response to the first cross-voltage and the first resistance value, a first current I1 flows through the light emitter unit 122 to light up a number of cold cathode fluorescent lamps to provide a first light intensity, for example the magnitude of the first current I1 is such as 7 mA. When the flat display 100 switches to display a 3D image, the switch SW1 is turned on, the resistor module 124 provides a second resistance value (which equal to the parallel resistance value of the resistors R1 and R2), and the second resistance value is lower than the first resistance value. In response to the first cross-voltage and the second resistance value, a second current I2 flows through the light emitter unit 122 to light up a number of cold cathode fluorescent lamps to provide a second light intensity, for example the magnitude of the second current I2 is such as 10 mA. In the first embodiment, the second current I2 is higher than the first current I1, so the second light intensity is higher than the first light intensity.

Figure 3:
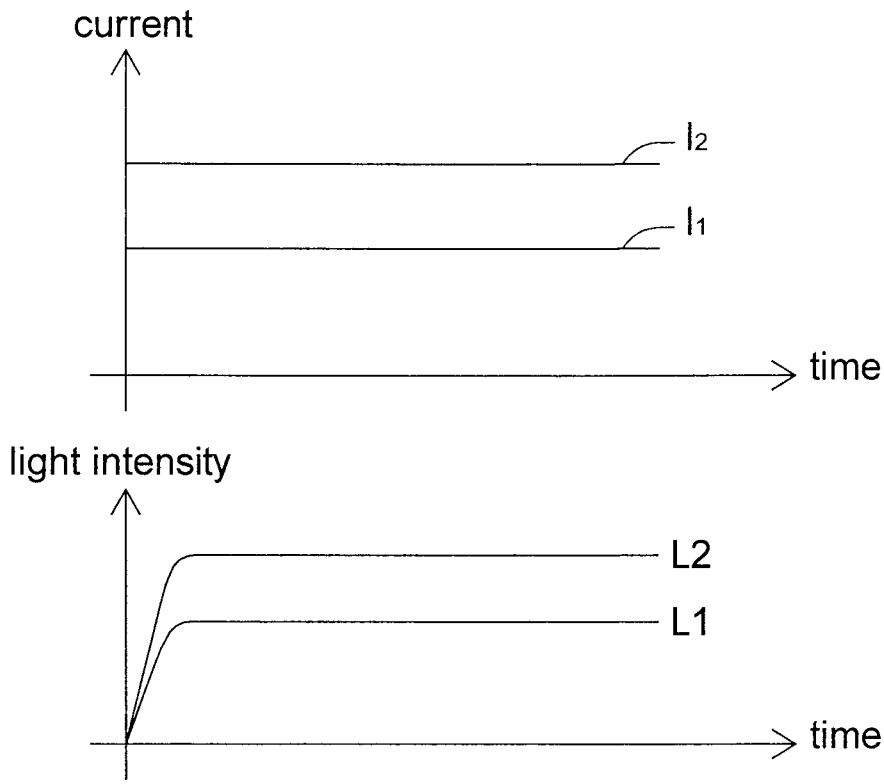
FIG. 3 shows an current vs. light intensity relationship of a light emitter unit according to the first embodiment.

As shown in FIG. 3, a current vs. light intensity relationship of a light emitter unit of the first embodiment is shown. When the flat display 100 displays a 3D image with the turned off switch SW1, the light emitter unit 122 is lit up with the first current I1, then the first light intensity provided by the light emitter unit 122 has a light intensity L1 ranging between 30~40 nits. When the flat display 100 displays a 3D image with the turned on switch SW1, the light emitter unit 122 is lit up with a second current I2, then the second light intensity provided by the light emitter unit 122 has a light intensity L2 being merely 80 nits. Thus, the light intensity deficiency, which occurs when the flat display 100 is switched from 2D image mode to 3D image mode, can be largely improved, and the viewer will not feel a darker 3D image.

The 3D image is constructed from a left-eye frame image and a right-eye frame image sequentially provided to a viewer's left eye and right eye respectively. Since the flat display 100 adopts hold-type driving method, the left-eye frame image shall be seen by a viewer's left eye until all the data of the left-eye frame image are already loaded to the panel 110. Otherwise, the viewer's left eye will receive the previous frame image (a previous right-eye frame image) and cannot view the correct image. This situation is named Cross-Talk. Therefore, when the flat display 100 displays a 3D image, the inverter 126 and the resistor module 124 provide the second current to light up the light emitter unit 122 only during a blanking time of each left-eye frame image and right-eye frame image. That is, the backlight module 120 provides the second light intensity to the panel 110 during the blanking time of each left-eye frame image and right-eye frame image.

Figure 4:
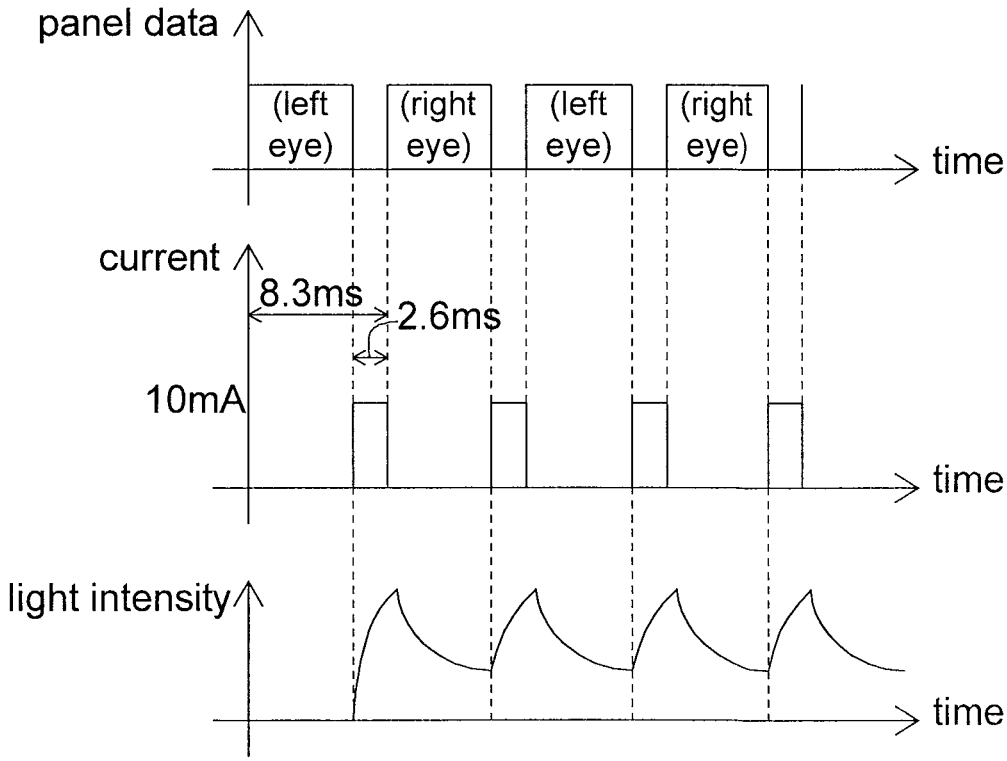
FIG. 4 shows another current vs. light intensity relationship of a light emitter unit according to a second embodiment.

As shown in FIG. 4, a current vs. light intensity relationship of a light emitter unit of a second embodiment is shown. Assume that the update frequency rate of the panel 110 is 120 Hz (the frame is updated every 8.3 ms). When the flat display 100 displays a 3D image, the backlight module 120 starts to flash, that is, the backlight module 120 provides a light only during the blanking time (about 2.6 ms) of each image frame and does not provide any light in any other time. The inverter 126 and the resistor module 124, which respectively provide the first cross-voltage and the second resistance value only during the blanking time of each image frame, and the inverter 123 generates the second current I2 only during the blanking time. Thus, the light emitter unit 122, which is transiently turned off, will not generate blurring caused by the previous image frame, so the viewer can view a correct image. Since the backlight module 120 is not lit up all the time, the second current I2 with higher magnitude improves the light intensity of the flat display 100 when displaying a 3D image, hence increasing the average light intensity of the flat display 100.

The backlight module 120 can further include a capacitor module 128. As shown in FIG. 2, the capacitor module 128 includes a first capacitor C1, a second capacitor C2 and a second switch SW2. When the flat display 100 displays the 2D image, the capacitor module 128 provides a first capacitance value (which equal to the capacitance value of the capacitor C1) to the inverter 126 to generate a first cross-voltage. When the flat display 100 displays a 3D image, the capacitor module 128 provides a second capacitance value (which equal to the parallel capacitance value of the capacitors C1 and C2) to the inverter 126 to generate a second cross-voltage, wherein the second capacitance value is higher than the first capacitance value, and the second cross-voltage is higher than the first cross-voltage. Thus, when the flat display 100 displays the 3D image, the light emitter unit 122 can be driven with higher current so as to quickly achieve the predetermined level of light intensity. Furthermore, the light source does not have to be driven by current or voltage, and can be driven by other power source as long as the light source can display a light intensity higher than the 2D image when the flat display is switched to the 3D image.

Figure 5:
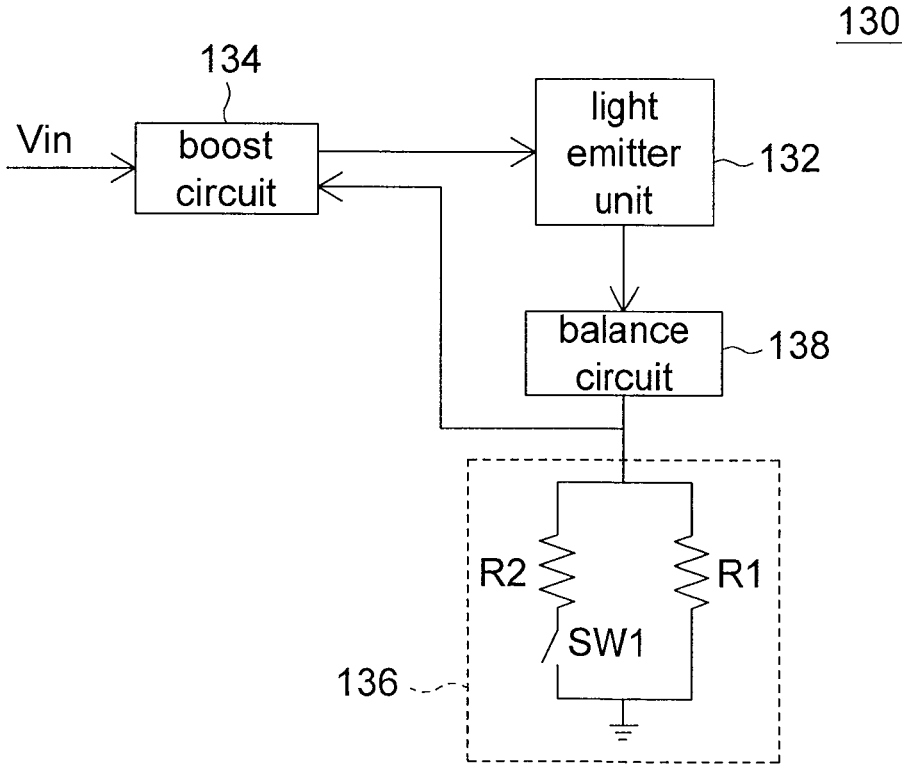
FIG. 5 shows a backlight module according to a third embodiment.

In the embodiments, the light emitter unit can be formed by at least one of light emitting diodes (LED), and there is not any restrictions regarding the formation of the light emitter unit. As shown in FIG. 5, a backlight module of a third embodiment is shown. The backlight module 130 includes a light emitter unit 132, a boost circuit 134, a resistor module 136 and a balance circuit 138. The light emitter unit 132, which includes a number of LED boost circuits 134, receives and converts an input voltage $V_{in}$. The resistor module 136 is coupled to the boost circuit 134 and the light emitter unit 132. The balance circuit 138 judges the magnitudes of respective currents flowing through these light emitting diodes, and further transmits a compensation signal to the boost circuit 134 to perform feedback compensation so as to maintain balance between the currents flowing through these light emitting diodes. The balance circuit 138 is coupled between the light emitter unit 132 and the resistor module 136, and any other types of coupled condition can be used and are within the scope of this disclosure.

The resistor module 136 such as includes a first resistor R1, a second resistor R2 and a switch SW1. If the flat display 100 is used for displaying 2D image, the switch SW1 is not turned on and the resistor module 136 provides a first resistance value (which equal to the resistance value of the resistor R1) so that the boost circuit 134 converts an input voltage $V_{in}$ into a first cross-voltage, and a first current I1 flows through the light emitter unit 132 to light up a number of light emitting diodes to provide a first light intensity, for example the magnitude of the first current is such as 20 mA. When the flat display 100 displays a 3D image, the resistor module 136 provides a second resistance value (which equal to the parallel resistance of the resistors R1 and R2) so that the boost circuit 134 converts an input voltage $V_{in}$ into a second cross-voltage, and a second current I2 flows through the light emitter unit 132 to light up a number of light emitting diodes to provide a second light intensity, for example the magnitude of the second current is such as 70 mA. The second resistance value is lower than the first resistance value. The second cross-voltage is higher than the first cross-voltage. The second light intensity is higher than the first light intensity. Thus, when the flat display 100 displays a 3D image, the light emitter unit 132, being driven by a higher current, provides a higher light intensity, so that the problem of light intensity deficiency which occurs when the flat display 100 is switched to 3D image from 2D image will be great improved, and the viewer will not feel the 3D image darker.

In one embodiment, a flat display driving method is also provided. The flat display includes a panel and a backlight module. The flat display driving method includes the following steps. When the flat display displays a 2D image, the backlight module provides a first light intensity to the panel. When the flat display displays a 3D image, the backlight module provides a second light intensity to the panel. The second light intensity is higher than the first light intensity.

The operations and principles of the flat display and the backlight module used in the flat display driving method are already explained in the disclosure of the flat display 100 and the backlight modules 120 and 130, and are not repeated here.

The flat display, the backlight module and the driving method thereof disclosed in above embodiments have many advantages exemplified below:

According to the flat display, the backlight module and the driving method disclosed in above embodiments, when the flat display switches to 3D image from 2D image, the light emitter unit is turned on by higher currents so that the light emitter unit provides a higher light intensity to the panel, hence resolving the problem of light intensity deficiency for the flat display. In addition, the backlight module of the invention further provides a light to the panel only during the blanking time of each image frame of the 3D image, hence resolving the blurring problem of 3D image and providing the viewer with correct, clear images.

As is understood by a person skilled in the art, the foregoing embodiments are illustrative rather than limiting. It is intended to cover various modifications and similar arrangements included within the spirit and scope of the appended claims, the scope of which should be accorded the broadest interpretation so as to encompass all such modifications and similar structure.

What is claimed is:

1. A flat display for displaying a two-dimensional (2D) image and a three-dimensional (3D) image, the flat display comprising:

a panel; and a backlight module configured to provide light to the panel, wherein when the flat display displays the 2D image, the backlight module is configured to provide a first light intensity to the panel, when the flat display displays the 3D image, the backlight module is configured to provide a second light intensity which is higher than the first light intensity to the panel, and when the flat display displays the 3D image, the backlight module is configured to provide the second light intensity to the panel only during a blanking time of each image frame of the 3D image.

2. The flat display according to claim 1, wherein the backlight module comprises:

a light emitter unit comprising a plurality of cold cathode fluorescent lamps (CCFLs);

a resistor module serially connected to the light emitter unit;

an inverter configured to receive an input voltage, convert the input voltage into a first cross-voltage or a second cross-voltage, and transmit the first cross-voltage or the second cross-voltage to the light emitter unit and the resistor module which are coupled in series; and a balance circuit configured to transmit a compensation signal to the inverter according to respective values of a plurality of currents flowing through the cold cathode fluorescent lamps, wherein when the flat display displays the 2D image, the resistor module is configured to provide a first resistance value so that a first current flows through the light emitter unit to generate the first light intensity, when the flat display displays the 3D image, the resistor module is configured to provide a second resistance value so that a second current flows through the light emitter unit to generate the second light intensity, the second resistance value is lower than the first resistance value, and the second current is higher than the first current.

3. The flat display according to claim 2, wherein the backlight module further comprises a capacitor module configured to provide a first capacitance value to the inverter to generate the first cross-voltage when the flat display displays the 2D image, and provide a second capacitance value to the inverter to generate the second cross-voltage when the flat display used for displaying the 3D image, the second capacitance value is higher than the first capacitance value, and the second cross-voltage is higher than the first cross-voltage.

4. The flat display according to claim 1, wherein the backlight module comprises:

a light emitter unit comprising a plurality of light emitting diodes (LEDs);

a boost circuit configured to receive an input voltage and convert the input voltage into a first cross-voltage or a second cross-voltage;

a resistor module coupled to the boost circuit and the light emitter unit; and a balance circuit configured to transmit a compensation signal to the boost circuit according to respective values of a plurality of currents flowing through these light emitting diodes, when the flat display displays the 2D image, the resistor module provides a first resistance value so that the boost circuit converts the input voltage into the first cross-voltage for enabling the light emitter unit to generate the first light intensity, when the flat display displays the 3D image, the resistor module provides a second resistance value so that the boost circuit converts the input voltage into the second cross-voltage for enabling the light emitter unit to generate the second light intensity, the second resistance value is lower than the first resistance value, and the second cross-voltage is higher than the first cross-voltage.

5. A backlight module used for providing a light to a panel, the backlight module comprising:

a light emitter unit comprising a plurality of cold cathode fluorescent lamps;

a resistor module serially connected to the light emitter unit;

an inverter used for receives and converts an input voltage into a first cross-voltage and further transmitting the cross-voltage to the light emitter unit and the resistor module which are coupled in series; and a balance circuit used for transmitting a compensation signal to the inverter according to respective values of a plurality of currents flowing through these cold cathode fluorescent lamps;

wherein, when the panel displays a 2D image, the resistor module provides a first resistance value so that a first current flows through the light emitter unit to generate a first light intensity, and when the panel displays a 3D image, the resistor module provides a second resistance value so that a second current flows through the light emitter unit to generate a second light intensity, and the second resistance value is lower than the first resistance value, the second current is higher than the first current, and the second light intensity is higher than the first light intensity.

6. The backlight module according to claim 5, wherein when the panel displays the 3D image, the backlight module provides the second light intensity to the panel only during a blanking time of each image frame of the 3D image.

7. The backlight module according to claim 5, further comprising:

a capacitor module coupled to the inverter;

wherein, when the panel displays the 2D image, the capacitor module provides a first capacitance value to the inverter to generate the first cross-voltage, and when the panel displays the 3D image, the capacitor module provides a second capacitance value to the inverter to generate a second cross-voltage, the second capacitance value is higher than the first capacitance value, and the second cross-voltage is higher than the first cross-voltage.

8. A backlight module used for providing a light to a panel, the backlight module comprising:

a light emitter unit comprising a plurality of light emitting diodes;

a boost circuit used for receives and converts an input voltage;

a resistor module coupled to the boost circuit and the light emitter unit; and a balance circuit used for transmitting a compensation signal to the boost circuit according to respective values of a plurality of currents flowing through these light emitting diodes;

wherein, when the panel displays the 2D image, the resistor module provides a first resistance value so that the boost circuit converts the input voltage into a first cross-voltage for enabling the light emitter unit to generate a first light intensity, and when the panel displays the 3D image, the resistor module provides a second resistance value so that the boost circuit converts the input voltage into a second cross-voltage for enabling the light emitter unit to generate a second light intensity, and the second resistance value is lower than the first resistance value, the second cross-voltage is higher than the first cross-voltage, and the second light intensity is higher than the first light intensity.

9. The backlight module according to claim 8, wherein when the panel displays the 3D image, the backlight module provides the second light intensity to the panel only during a blanking time of each image frame of the 3D image.

10. A method of driving a flat display, the flat display comprising a panel and a backlight module, the method comprising:

providing a first light intensity to the panel by the backlight module when the flat display displays a two-dimensional (2D) image; and providing a second light intensity to the panel by the backlight module when the flat display displays a three-dimensional (3D) image, wherein the second light intensity is higher than the first light intensity, and when the flat display displays the 3D image, the backlight module provides the second light intensity to the panel only during a blanking time of each image frame of the 3D image.

11. The method according to claim 10, wherein the backlight module comprises a light emitter unit, a resistor module, an inverter, and a balance circuit, the light emitter unit comprises a plurality of cold cathode fluorescent lamps, the resistor module and the light emitter unit are connected in series, the inverter receives an input voltage, converts the input voltage into a first cross-voltage or a second cross-voltage, and transmits the first cross-voltage or the second cross-voltage to the light emitter unit and the resistor module which are coupled in series, and the method further comprises:

transmitting a compensation signal to the inverter by the balance circuit according to respective values of a plurality of currents flowing through these cold cathode fluorescent lamps;

providing a first resistance value by the resistor module when the flat display displays the 2D image so that a first current flows through the light emitter unit to generate the first light intensity; and providing a second resistance value by the resistor module when the flat display displays the 3D image so that a second current flows through the light emitter unit to generate the second light intensity, wherein the second resistance value is lower than the first resistance value, and the second current is higher than the first current.

12. The method according to claim 11, wherein the backlight module further comprises a capacitor module, the method further comprises:

providing a first capacitance value to the inverter by the capacitor module to generate the first cross-voltage when the flat display displays the 2D image, and providing a second capacitance value to the inverter by the capacitor module to generate the second cross-voltage when the flat display used for displaying the 3D image, the second capacitance value is higher than the first capacitance value, and the second cross-voltage is higher than the first cross-voltage.

13. The method according to claim 10, wherein the backlight module comprises a light emitter unit, a boost circuit, a resistor module, and a balance circuit, the light emitter unit comprises a plurality of light emitting diodes, the boost circuit receives an input voltage and converts the input voltage into a first cross-voltage or a second cross-voltage, the resistor module is coupled to the boost circuit and the light emitter unit, the method further comprises:

transmitting a compensation signal to the boost circuit by the balance circuit according to respective values of a plurality of currents flowing through these light emitting diodes;

providing a first resistance value by the resistor module when the flat display displays the 2D image so that the boost circuit converts the input voltage into a first cross-voltage for enabling the light emitter unit to generate the first light intensity; and providing a second resistance value by the resistor module for enabling the light emitter unit to generate the second light intensity when the flat display displays the 3D image, the second resistance value is lower than the first resistance value, and the second cross-voltage is higher than the first cross-voltage.

14. A flat display used for displaying a 2D image and a 3D image, the flat display comprising:

a panel; and a backlight module used for providing a light to the panel, wherein when the flat display displays the 2D image, the backlight module provides a first light intensity to the panel, and when the flat display displays the 3D image, the backlight module provides a second light intensity which is higher than the first light intensity to the panel, the backlight module comprises:

a light emitter unit comprising a plurality of cold cathode fluorescent lamps (CCFLs);

a resistor module serially connected to the light emitter unit;

an inverter used for receiving and converting an input voltage into a first cross-voltage and further transmitting the cross-voltage to the light emitter unit and the resistor module which are coupled in series; and a balance circuit used for transmitting a compensation signal to the inverter according to respective values of a plurality of currents flowing through these cold cathode fluorescent lamps, and when the flat display displays the 2D image, the resistor module provides a first resistance value so that a first current flows through the light emitter unit to generate the first light intensity, and when the flat display displays the 3D image, the resistor module provides a second resistance value so that a second current flows through the light emitter unit to generate the second light intensity, and the second resistance value is lower than the first resistance value, and the second current is higher than the first current.

15. The flat display according to claim 14, wherein the backlight module further comprises a capacitor module, which provides a first capacitance value to the inverter to generate the first cross-voltage when the flat display displays the 2D image and provides a second capacitance value to the inverter to generate a second cross-voltage when the flat display used for displaying the 3D image, the second capacitance value is higher than the first capacitance value, and the second cross-voltage is higher than the first cross-voltage.

* * * * *